US008415871B2

(12) United States Patent
Onishi

(10) Patent No.: US 8,415,871 B2
(45) Date of Patent: Apr. 9, 2013

(54) IMAGE DISPLAY APPARATUS

(75) Inventor: Tomoya Onishi, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 786 days.

(21) Appl. No.: 12/631,225

(22) Filed: Dec. 4, 2009

(65) Prior Publication Data

US 2010/0156296 A1 Jun. 24, 2010

(30) Foreign Application Priority Data

Dec. 24, 2008 (JP) ..... 2008-328064

(51) Int. Cl.
*H01J 1/62* (2006.01)

(52) U.S. Cl.
USPC ..... 313/495; 313/496; 313/584; 313/586

(58) Field of Classification Search ..... 313/495, 313/496, 584, 586, 587, 489, 473
See application file for complete search history.

(56) References Cited

U.S. PATENT DOCUMENTS

| | | | | |
|---|---|---|---|---|
| 6,750,854 | B1 | 6/2004 | Onishi | |
| 7,400,082 | B2 | 7/2008 | Suzuki et al. | 313/473 |
| 7,458,870 | B2 | 12/2008 | Onishi | |
| 2006/0001358 | A1 | 1/2006 | Onishi | |
| 2006/0103294 | A1 | 5/2006 | Suzuki et al. | 313/496 |

FOREIGN PATENT DOCUMENTS

JP 2006-173094 6/2006

*Primary Examiner* — Vip Patel
(74) *Attorney, Agent, or Firm* — Fitzpatrick, Cella, Harper & Scinto

(57) ABSTRACT

An image display apparatus has a plurality of phosphor films two-dimensionally disposed on a substrate, a matrix-pattern rib formed on the substrate to partition between the phosphor films, a plurality of metal backs each covering at least one phosphor film, and resistance wirings having a sheet resistance higher than that of the metal backs for electrically connecting the plurality of metal backs to each other. The resistance wirings are disposed to the apexes of the matrix-pattern rib and composed of a plurality of column lines and a plurality of row lines, the metal backs have first portions for covering the phosphor films on the substrate and second portions formed along the rib to connect the first portions to the column lines.

4 Claims, 8 Drawing Sheets

IMAGE DISPLAY APPARATUS

BACKGROUND OF THE INVENTION

1. Field of the Invention

The invention relates to an image display apparatus, and more particularly to a structure of a phosphor substrate of the image display apparatus.

2. Description of the Related Art

There has been known a flat panel display of a system for emitting phosphor by electron beams emitted from electron-emitting devices. This type of the image display apparatus includes an electron source substrate having a lot of electron-emitting devices (a rear plate) and a phosphor substrate (face plate) on which phosphor films corresponding to the respective devices are disposed. A metal back as an anode electrode is disposed to the faceplate, and a high voltage of about, for example, 10 kV is applied to the metal back to accelerate emitted electrons.

When a discharge occurs between the face plate and the rear plate, a charge accumulated to the metal back flows to the rear plate. When the charge has a large current, there is a possibility that structural members such as the electron-emitting devices, wires, and the like are broken as well as drive circuits are broken. To cope with the above problem, it is preferable to increase the impedance of the face plate to restrict a current in a discharge operation. As an effective means for increasing it, there has been known an arrangement for dividing the metal back and connecting the divided metal backs to each other through high resistance members (refer to Japanese Patent Application Laid-Open No. 2006-173094).

However, in the arrangement for connecting the divided metal backs by the high resistance members, a voltage drop occurs due to a current flowing in the high resistance member in the discharge. Thus, a potential difference corresponding to the voltage drop is made between the adjacent metal backs or between the metal backs and the high resistance members. When the potential difference increases to a certain high level, a discharge occurs between the metal backs or between the metal backs and the high resistance members. Hereinafter, the phenomenon is called a collapse between the metal backs or between the metal backs and the high resistance members.

To prevent the collapse between the metal backs, it is sufficient to reduce an electric field strength applied between the adjacent metal backs and between the metal backs and the high resistance members in the discharge. Countermeasures to solve the above problems are as follows: (1) to reduce the amount of the voltage drop by reducing the resistance value of the high resistance members and (2) to increase the distance between the metal backs and distance between the metal backs and the high resistance members. The countermeasure (1) is not preferable because the decrease of the resistance value increases a discharged current. The countermeasure (2) restricts the shape and the size of the metal back.

The metal backs require a size that can cover the phosphor films. This is because a role of the metal backs is to apply an acceleration voltage to the phosphor films and to reflect light generated from the phosphor films. It is preferable that each of the phosphor films has a larger area from a viewpoint of improvement of luminance. Accordingly, it is desired that the metal backs that cover the phosphor films have also a large area.

From the above circumstances, a problem of trade-off occurs in that it is desired to increase the distance between the metal backs and the distance between the metal backs and the high resistance members as much as possible while increasing the areas of the metal backs.

SUMMARY OF THE INVENTION

An object of the invention, which was made in view of the above circumstances, is to provide a technique for increasing the distance between metal backs and the distance between the metal backs and the high resistance members while securing the area of the metal backs.

In order to accomplish the purpose, the present invention is configured as follows.

An image display apparatus comprising:

a plurality of phosphor films two-dimensionally disposed on a substrate;

a matrix-pattern rib formed on the substrate to partition the phosphor films;

a plurality of metal backs each covering at least one phosphor film; and resistance wirings which have a sheet resistance higher than that of the metal backs, and electrically connect the plurality of metal backs to each other, wherein the resistance wirings are disposed to the apexes of the matrix-pattern rib and composed of a plurality of column lines and a plurality of row lines, the metal backs have first portions covering the phosphor films on the substrate and second portions formed along the rib to connect the first portions to the column lines, and the width of the second portions in a column direction at the apexes of the rib is smaller than the width of the first portions in the column direction.

According to the invention, the distance between the metal backs and the distance between the metal backs and the high resistance members can be increased while securing the area of the metal backs.

Further features of the present invention will become apparent from the following description of exemplary embodiments with reference to the attached drawings.

DESCRIPTION OF THE EMBODIMENTS

Figure 1A:
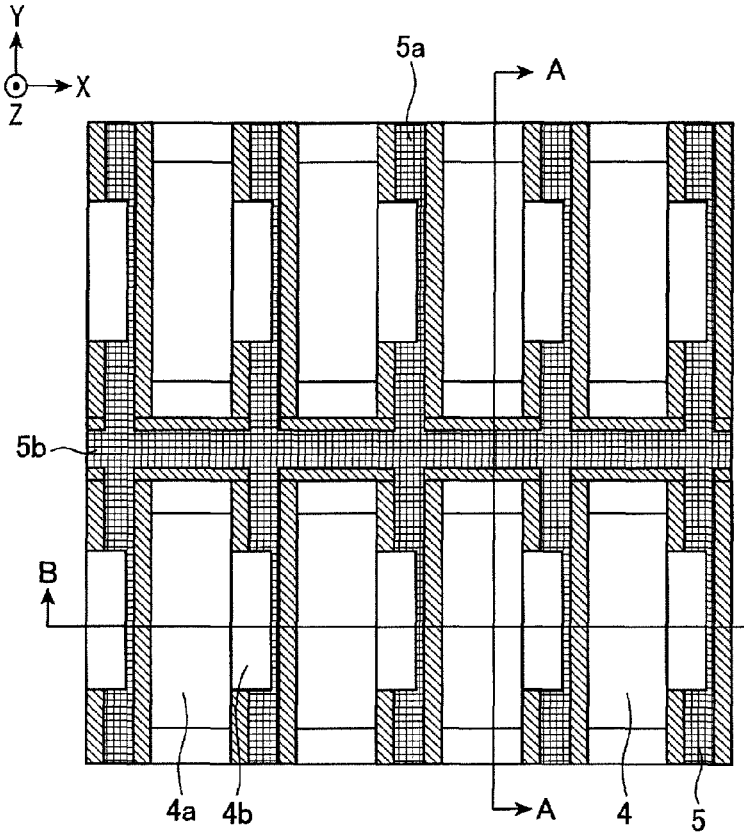
FIG. 1A is a schematic plan view of a face plate of a first embodiment.

Exemplary embodiments of the invention will be described below in detail referring to the drawings.

An image display apparatus according to embodiments of the invention is an electron beam display of a system for emitting phosphor by electron beams and has a field emission display (FED), a surface-conductive electron-emitting display (SED), and a Cathode Ray Tube Display (CRT-display).

Since the distance between an electron source substrate (a rear plate), on which electron-emitting devices are disposed, and a phosphor substrate (a face plate), on which phosphor is disposed, is short and thus the electrostatic capacitance between both the substrates is large, the SED and the FED have a tendency that a current flowing thereto increases in a discharge operation. Accordingly, the SED and the FED are modes to which an advantage of the invention is particularly expected. Note that exemplified as the electron-emitting devices used in the FED are Spindt type, metal insulator metal type (MIM type), carbon nanotube type, and Ballistic-electron Surface-emitting Device type (BSD type) electron-emitting devices, and the like. The embodiments described below will exemplify an image display apparatus using surface conductive type electron-emitting devices.

(First Embodiment)

Figure 1B:
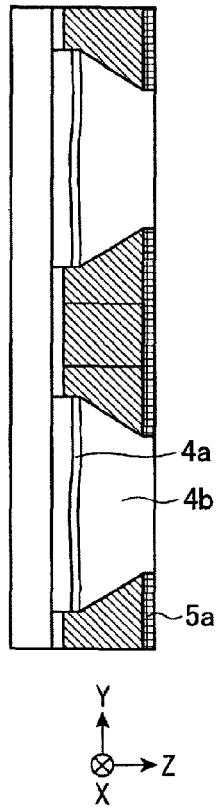
FIG. 1B is an A-A sectional view of FIG. 1A.
Figure 1C:
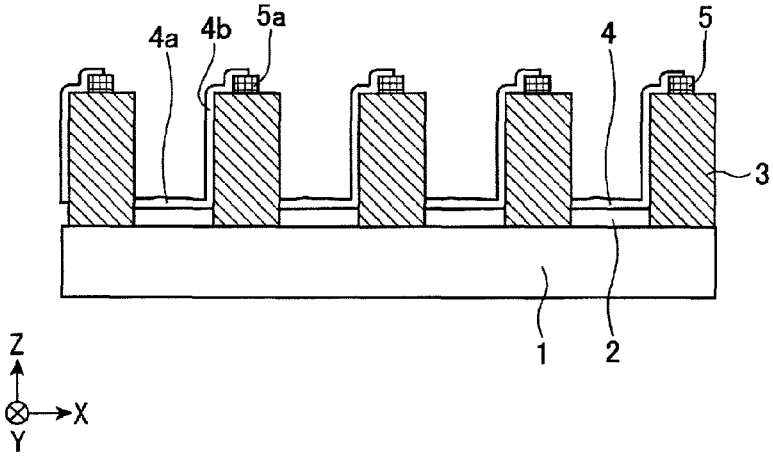
FIG. 1C is a B-B sectional view of FIG. 1A.

An image display apparatus of a first embodiment of the invention will be described referring to FIGS. 1A, 1B, and 1C. FIG. 1A is a schematic plan view of a face plate 1 of the first embodiment and illustrates a mode when it is viewed from a rear plate (not illustrated) side. FIG. 1B is an A-A sectional view of FIG. 1A, and FIG. 1C is a B-B sectional view of FIG. 1A. It is defined that an X-direction and a Y-direction are in parallel with the faceplate 1, and that a direction from the face plate 1 (XY plane) to the rear plate is a Z-direction. The X-direction is called also a row direction, the Y-direction is called also a column direction, and the Z-direction is called also a height direction for the purpose of convenience.

A plurality of phosphor films 2 is two-dimensionally disposed on the face plate 1. To partition between the phosphor films 2, matrix-pattern rib structures (partitions) 3 are formed on a substrate of the faceplate 1. Further, a plurality of metal backs 4, which cover the surfaces of the phosphor films 2, and feeding members (resistance wires) 5, which electrically connect the metal backs with each other and feed an acceleration voltage to the metal backs are disposed.

A transparent insulator substrate is preferably used as a material of the face plate 1 to observe light emission of the phosphor therethrough, and sheet glass such as soda lime glass and the like is preferably used in addition to the above material, high strain point glass, which is used in a field of a plasma display panel, and the like are also preferably used.

The phosphor films 2 are layers composed of a phosphor material that emits light by being irradiated with electron beams. Powder phosphor such as P22 phosphor used in CRT, which is excited by electron beams and emits light, is preferably used as the phosphor. In particular, the P22 phosphor can be preferably used because it is excellent in emission colors, emission efficiency, a color balance, and the like. The phosphor films 2 are formed by screen print, photolithography, ink jet, and the like. In particular, the screen print is preferably used from a viewpoint of material use efficiency.

The rib structures 3 have (1) a role of forming a partition between adjacent phosphor films 2, and (2) a role of increasing the distance (not a straight distance) along the plane between adjacent metal backs and the distance along the surface between each of first portions 4*a* of the metal backs to be described later and each of the feeding members. The role of the item (1) is to prevent electrons discharged from the electron-emitting devices from being incident on other phosphor films and to prevent reflective electrons and secondary electrons generated in the phosphor films from being incident on peripheral phosphor films. The role of the item (2) is to prevent a discharge between the metal backs.

An insulation member (a material having a volume resistivity sufficiently higher than that of the feeding members 5) can be used as a material of the rib structures 3. For example, glass flit, a calcined body of metal oxide such as alumina, glass, and the like can be used. In particular, a material composed of a mixture of the metal oxide such as alumina and the glass flit can be preferably used from a viewpoint of a calcining temperature and a strength.

The shape of the rib structures 3 is preferably formed to have a matrix-pattern in an XY-direction to dispose the feeding members 5 thereto. The height in the Z-direction of the rib structures 3 from the substrate is preferably 50 μm or more and is more preferably 100 μm or more to sufficiently separate the metal backs from each other or the metal backs from the feeding members. At the same time, the height in the Z-direction of the rib structures 3 from the substrate is preferably 1 mm or less and is more preferably 500 μm or less from a viewpoint of easiness of manufacture. The rib structures 3 can be formed by screen print, photolithography, sand blast, and the like. In particular, the sand blast can be preferably applied to the face plate as a plane substrate.

The metal backs 4 are members having (1) a role as anode electrodes to which the acceleration voltage is applied from the electron-emitting devices to accelerate discharged electrons and (2) a role of reflecting the light emitted in a rear plate direction of the light emitted from the phosphor to the face plate side. A thin-film-like metal is preferably used for the metal backs 4 because it must improve the reflectance of light while minimizing an energy loss of the accelerated electron beam. Aluminum is particularly preferably used as a material of the metal backs 4. The metal backs 4 are formed by a filming method, a transfer method, and the like that are publicly known in CRT. In particular, the filming method using resin intermediate films is preferably used because it can improve the reflectance of the metal backs.

The metal backs 4 are segmented in the X-direction and in the Y-direction in a face plate plane (this arrangement is called a two-dimensional segment). In other words, the plurality of metal backs 4 is two-dimensionally disposed in the X-direction and the Y-direction. The metal backs 4 are electrically connected to each other by the high resistance feeding members (resistance wirings) 5. Segmenting the metal backs as described above is advantageous in that a current can be restricted in a discharge operation because the amounts of charges accumulated to the respective metal backs can be reduced.

The feeding members 5 have a role of electrically connecting the metal backs to each other and flowing a current resulting from electron beams. In a drive operation, the acceleration voltage is applied to the metal backs from a not illustrated high voltage power supply through the feeding members 5. As illustrated in FIG. 1A, the feeding members 5 are disposed to the apexes (apex surfaces) of the matrix-pattern rib structures 3 and wired to a matrix-pattern by a plurality of Y-directional (column) lines 5*a* and a plurality of X-directional (row) lines 5*b*. Employment of the matrix-pattern (two-dimensional) wiring structure is advantageous in that dispersion of a metal back potential (anode potential) in a plane can be reduced as much as possible in the discharge operation and the drive operation.

The feeding members 5 have a sheet resistance higher than that of the metal backs 4. The resistance value of the feeding members 5 is set according to the characteristics of an electron beam source and a specification as a display. The condition of the upper limit of the resistance value is determined by an amount of voltage drop (an amount of voltage drop when a current or a discharge current resulting from the electron beams flows in the drive operation). When the resistance value is excessively high, the acceleration voltage changes and a luminance is lowered in the drive operation. Further, the condition of the lower limit of the resistance value is determined by an allowable discharge current. When the resistance value is excessively low, since a large amount of the discharge current flows, devices such as the electron-emitting devices are broken. From what has been described above, the resistance value of the feeding members 5 for connecting adjacent metal backs 4 is preferably about 100Ω to 100 MΩ and is more preferably 10 kΩ to 1 MΩ. A method of patterning, for example, a ruthenium oxide paste or a paste, in which a conductive member such as ITO and ATO is disposed, by screen print and photolithography can be used as a method of forming the feeding members having the above resistance value. Otherwise, a method of forming films by subjecting oxides such as ITO, ATO, and a semiconductor such as amorphous silicon to a gas-phase formation and patterning the films by photolithography can be used.

Since the feeding members 5 that connect the metal backs to each other have the high resistance; when a current is supplied to the phosphor films 2 by the electron beams, the voltage of the feeding members 5 is dropped by the current (anode current). When the voltage drop occurs, since the energy of the electrons for exciting the phosphor is reduced, a luminance is lowered. Since the amount of voltage drop of the feeding members 5 is determined by a resistance value from a feeding unit (high voltage power supply), a portion farther from the feeding unit has a larger amount of voltage drop. The in-plane dispersion of the amount of the voltage drop is not preferable because it is recognized as luminance unevenness.

Figure 4:
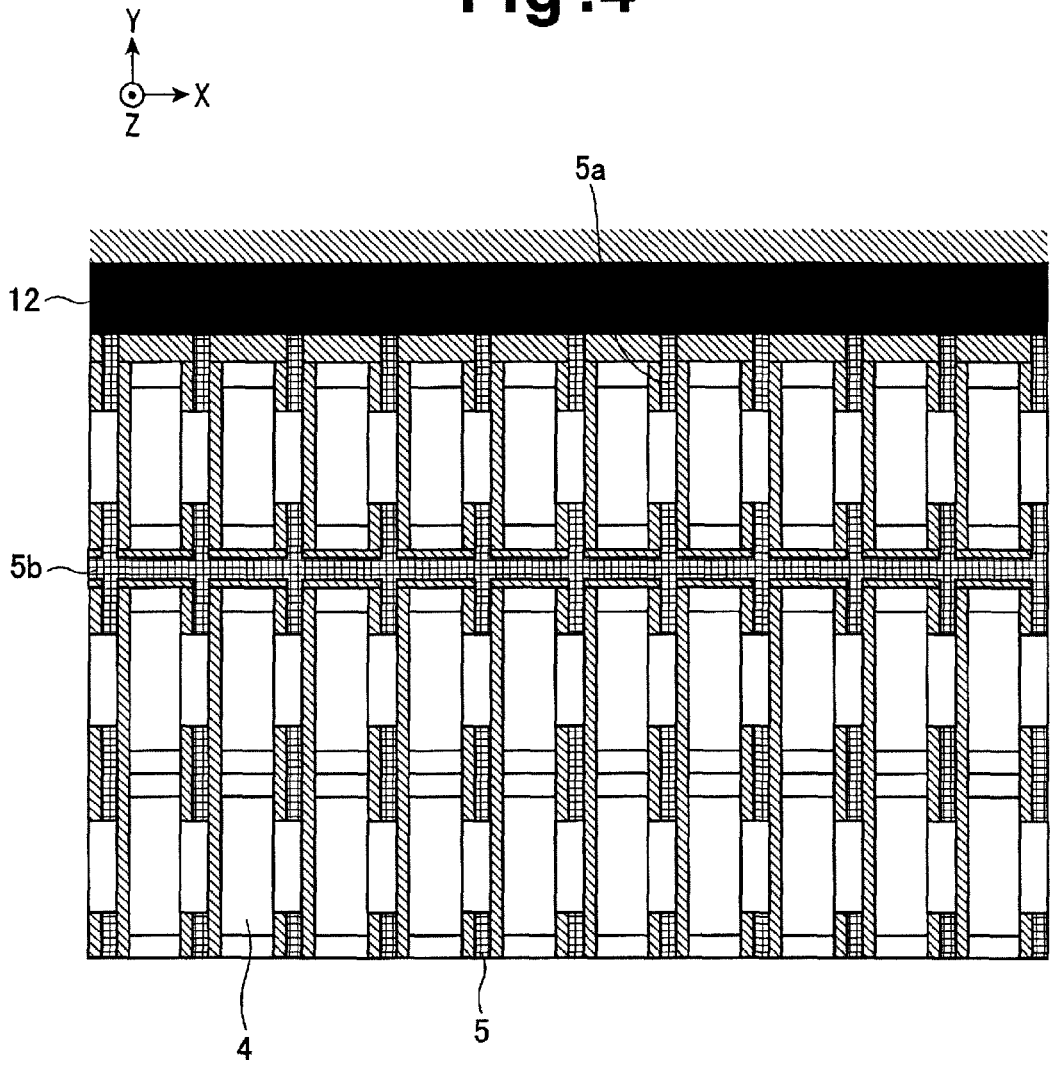
FIG. 4 is a view for explaining an arrangement of a common electrode.

Thus, it is preferable to connect the respective lines of the feeding members 5 to a common electrode 12 having a sheet resistance lower than that of the feeding members 5 as illustrated in FIG. 4. The common electrode corresponds to a potential defining member of the invention. In an example of FIG. 4, the Y-directional lines 5*a* are commonly connected to the common electrode 12 in the X-direction. With this arrangement, luminance unevenness can be reduced in the X-direction. Note that an arrangement, in which the X-directional lines 5*b* are connected to the common electrode or both the Y-directional lines 5*a* and the X-directional lines 5*b* are connected to the common electrode, is also preferable.

(Arrangement of Metal Backs)

Figure 2A:
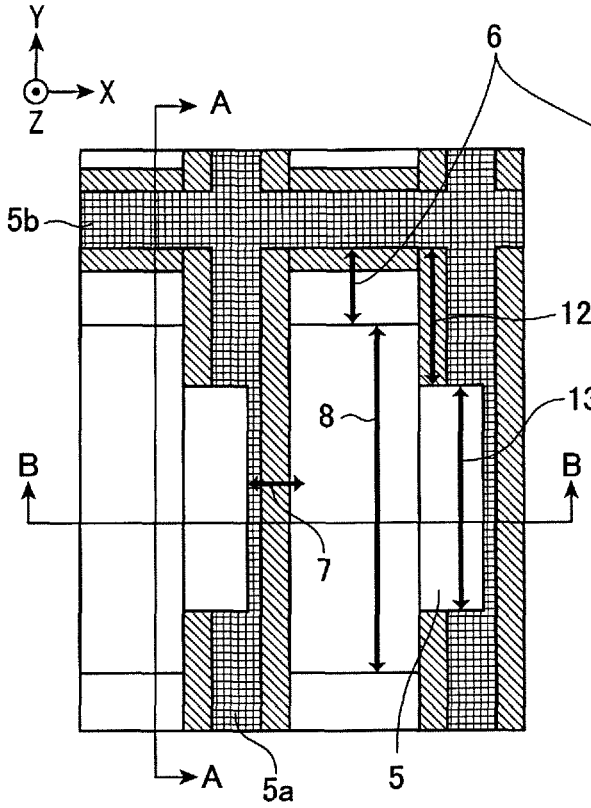
FIG. 2A is a schematic plan view of the face plate.

A detailed arrangement of the metal backs will be described referring to FIGS. 2A to 2C. FIG. 2A is a schematic plan view of the face plate, FIG. 2B is an A-A sectional view of FIG. 2A, and FIG. 2C is a B-B sectional view of FIG. 2A.

The metal backs 4 have first portions 4*a* covering the surfaces of the phosphor films 2 on the substrate and second portions 4*b* formed along the rib structures 3 to connect the first portions 4*a* to the column lines 5*a*. It can be said that the second portions 4*b* are drawing-out lines of the metal backs. As illustrated in FIG. 2B, the width in the column direction of the second portions 4*b* as the drawing-out lines (the size in the Y-direction) is gradually narrowed toward upward and made narrowest at the apexes of the rib structures 3. The portions of the second portions 4*b* existing at the apexes of the rib structures 3 are called junctions to the lines 5*a* in the column direction.

Since the metal backs 4 act as reflection films, they preferably cover the overall phosphor films 2. The size of the phosphor films 2 must be increased as much as possible to improve the luminance, from which it is naturally required to increase the size of the metal backs 4. On the other hand, it is required to secure a sufficient distance between the metal backs and between the metal backs and the feeding members to prevent a discharge.

Figure 2B:
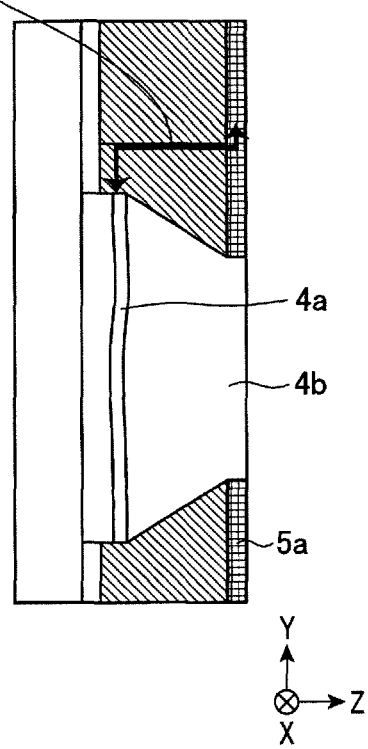
FIG. 2B is an A-A sectional view of FIG. 2A, and FIG. 2C a B-B sectional view of FIG. 2A.
Figure 2C:
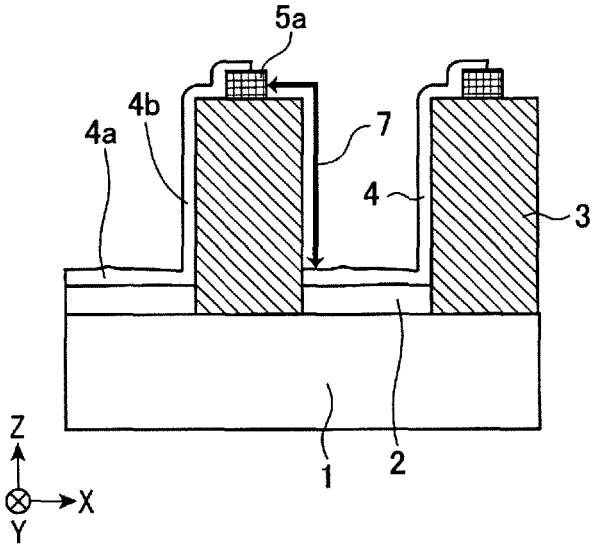

Thus, in the first embodiment, the rib structures 3 are disposed between adjacent phosphor films 2 as illustrated in FIGS. 2A to 2C. With this arrangement, the creeping distance between adjacent metal backs 4 (the first portions 4*a*) can be increased. Further, the feeding members 5 are formed to the apexes of the rib structures 3, and the metal backs 4 (the first portions 4*a*) are formed by being offset from the feeding members 5 in the Z-direction. With this arrangement, the distance between the metal backs 4 (the first portions 4*a*) and the Y-directional lines 5*a* (refer to the arrow 7) and the distance between the metal backs 4 and the X-directional lines 5*b* (refer to the arrow 6) can be increased. Accordingly, the distance between the metal backs 4 and the distance between the metal backs and the feeding members can be sufficiently secured while increasing the size of the first portions 4*a* of the metal backs 4 (refer to the arrow 8).

Further, in the first embodiment, the size of the second portions 4*b* in the Y-direction is made smaller than the size of the first portions 4*a* in the Y-direction, and, in particular, the size of the second portions 4*b* in the Y-direction (refer to an arrow 13) is minimized at the apexes of the rib structures 3 at which an electric field concentration is liable to occur. With this arrangement, the distance between the second portions 4*b* as the drawing-out lines of the metal backs 4 and the X-directional lines 5*b* is secured and even a discharge between the second portions 4*b* and the X-directional lines 5*b* can be prevented. The distance between the second portions 4*b* and the X-directional lines 5*b* (refer to an arrow 12) is preferably the same as that between the first portions 4*a* and the feeding members 5 (refer to the arrows 6 and 7). When, for example, the rib structures 3 have the height of 100 μm, since the distance shown by the arrows 6 and 7 is about 100 μm, it is preferable to secure about 100 μm to the distance shown by the arrow 12.

(Second Embodiment)

Figure 3A:
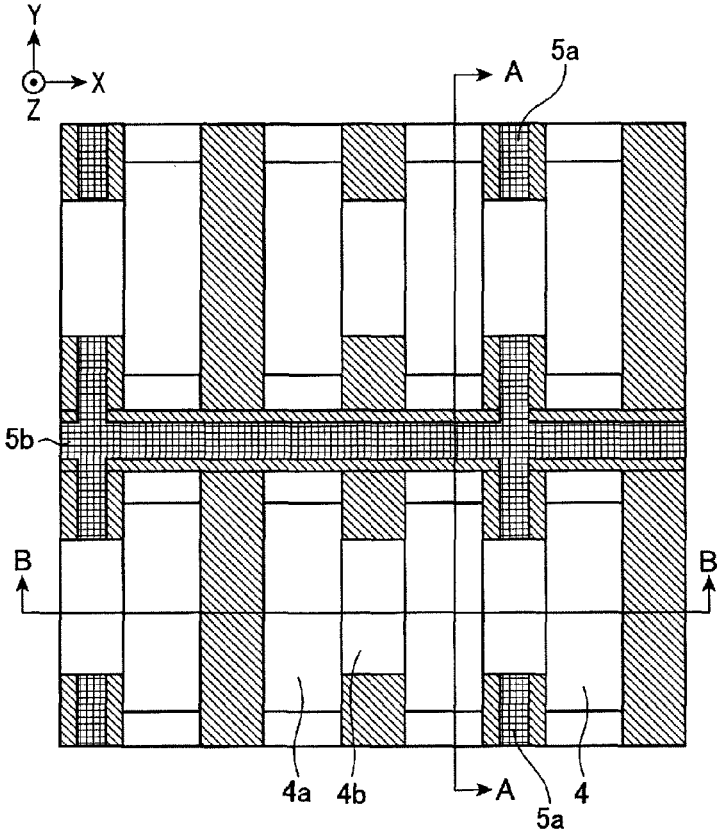
FIG. 3A is a schematic plan view of a face plate of a second embodiment.

An arrangement of metal backs of a second embodiment will be described referring to FIGS. 3A to 3C. FIG. 3A is a schematic plan view of the face plate, FIG. 3B is an A-A sectional view of FIG. 3A, and FIG. 3C is a B-B sectional view of FIG. 3A.

The first embodiment is arranged such that one metal back covers one phosphor film (one subpixel), whereas a second embodiment is arranged such that one metal back covers N pieces of phosphor films constituting one pixel (N is an integer of two or more). When, for example, one pixel is composed of three phosphor films for RGB, one metal back covers the three phosphor films of one pixel.

Figure 3B:
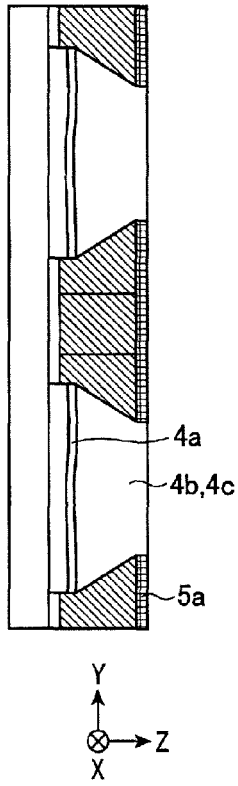
FIG. 3B is an A-A sectional view of FIG. 3A.
Figure 3C:
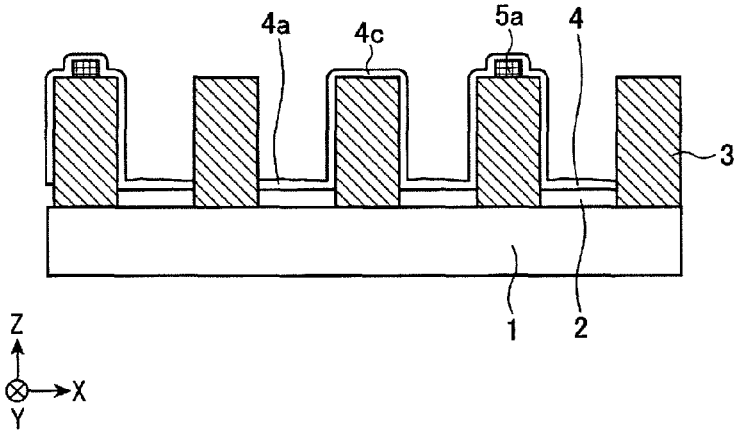
FIG. 3C is a B-B sectional view of FIG. 3A.

As illustrated in FIGS. 3A to 3C, the metal backs 4 have three first portions 4*a* for covering the phosphor films for RGB disposed in the X-direction, and third portions 4*c* formed along rib structures 3 for connecting between two first portions 4*a* adjacent to each other. The third portions 4*c* are formed to be across the rib structures 3, and the column direction width thereof (Y-direction size) are gradually narrowed toward upward and made narrowest at the apexes of the rib structures 3.

Y-directional lines 5*a* of feeding members 5 are formed to respective metal backs (i. e., to each three phosphor films). In an example of FIG. 3A, the third portions 4*c* on one hand have also a role as second portions 4*b* for connecting between the first portions 4*a* to the feeding members 5.

According to the arrangement of the second embodiment, a collapse between the metal backs (the third portions 4*c* and the second portions 4*b*) at the apexes of the rib structures 3 and X-directional lines can be prevented as much as possible like the first embodiment.

Further, the number of Y-directional lines of the feeding members 5 can be reduced. In the second embodiment, the number of the Y-directional lines can be reduced to ⅓ that of the arrangement in which the metal backs and the Y-directional lines are disposed to each subpixels as in, for example, the first embodiment.

When the metal backs and the Y-directional lines are individually disposed to respective R, G, B as in the first embodiment, there is a possibility that the amounts of voltage drop are dispersed by an anode current in respective colors. Since the potential (the acceleration voltage) of the metal backs is dispersed in the respective colors, the light emission intensity ratio of RGB changes, i. e., a color deviation occurs. The color deviation is not preferable because it is liable to be visually recognized. As to this point, the second embodiment is advantageous in that it can prevent the color deviation and improve an image quality by covering the phosphor films of all the colors, which constitute one pixel, by the single metal back.

The invention will be described below in detail by examples.

EXAMPLE 1

An example 1 shows an electron beam display using the face plate illustrated in FIGS. 1 and 4.

(Step 1: Formation of Rib Structure)

A soda lime glass substrate was used as the face plate 1. A paste made of alumina powder, glass frit, a resin binder, and a solvent was used as a material of the rib structures 3. Sandblast used for a plasma display panel (PDP) was used as a manufacturing method. The rib structures 3 were disposed in a two-dimensional matrix state and had an X-direction pitch set to 200 μm, a Y-direction pitch set to 600 μm, X-and Y-direction widths set to 100 μm and a height set to 150 μm. Respective openings (cells) partitioned by the rib structures 3 correspond to the sub pixels. After the rib structures 3 were formed by the sandblast, they were calcined at 500° C.

(Step 2: Formation of Feeding Members)

Feeding members (resistance wirings) 5 were formed to the upper surfaces of the created rib structures 3. A paste of ruthenium oxide was used as a material of the feeding members 5. Screen print was used as a method of creating the feeding members, and the feeding members were disposed in a two-dimensional matrix state and calcined at 480° C. After the feeding members were calcined, they were set to a width of 70 μm and a thickness of 5 μm. At the time, metal backs 4 adjacent to each other in the Y-direction had a resistance value of 100 kΩ therebetween.

(Step 3: Formation of Phosphor Film)

Phosphor films 2 were formed to openings of ribs of the thus manufactured substrate having a feeding structure. As a material of the phosphor films 2, P22 phosphor, which is publicly known in the field of CRT (red: Y202S: Eu/green: ZnS: Cu, AI/blue: ZnS; Ag, Cl) and pasted by a resin binder and a solvent was used. The material was dropped and printed by screen print. After the print, the material was calcined at 450° C. The film thickness of the phosphor films 2 was 10 to 20 μm after they were calcined.

(Step 4: Formation of Metal Backs)

The metal backs 4 were formed to the thus created phosphor films 2. Asa method of forming the metal backs, after resin intermediate films (not illustrated) were formed by spray-coating an acrylic emulsion, aluminum was patterned by a mask evaporation to obtain a desired pattern. The film thickness of the aluminum was set to 100 nm.

Figure 5A:
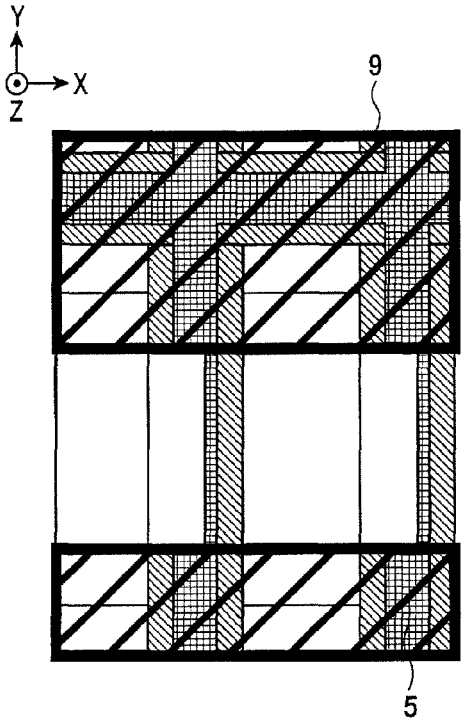
FIGS. 5A to 5C illustrate a method of disposing a mask of an example 1 and a directionality of evaporation.
Figure 5B:
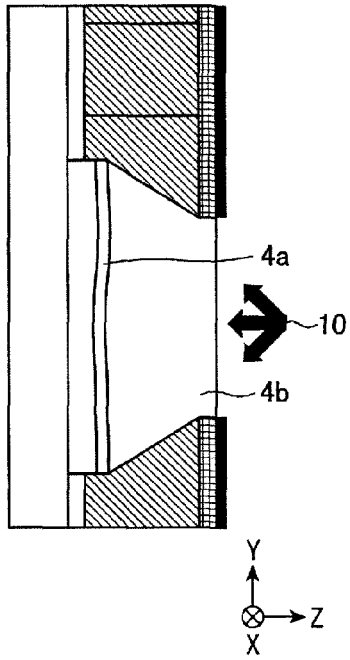
Figure 5C:
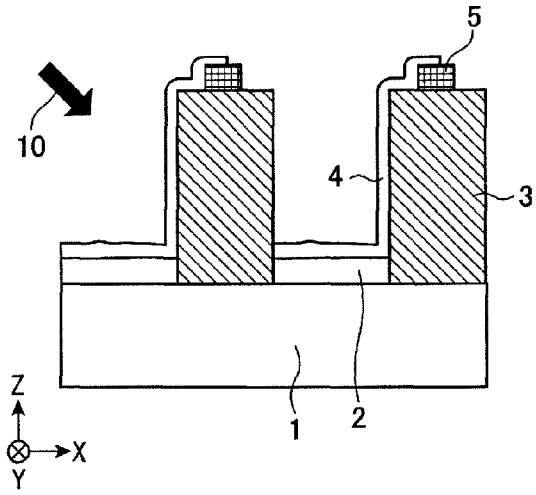

FIGS. 5A to 5C illustrate a method of disposing a mask 9 and a directionality of evaporation. The portions shown by slanting lines of FIG. 5A are regions to be masked by the mask 9.

In the example 1, the stripe-shaped mask 9 in the X-direction was used. The opening width (the width in the Y-direction) of the mask corresponds to the width of the metal backs 4 in the Y-direction at the apexes of the rib structures 3. The opening width of the mask was set to 200 μm. The metal backs were formed by the evaporation provided with the directionality using the mask 9.

Figure 6A:
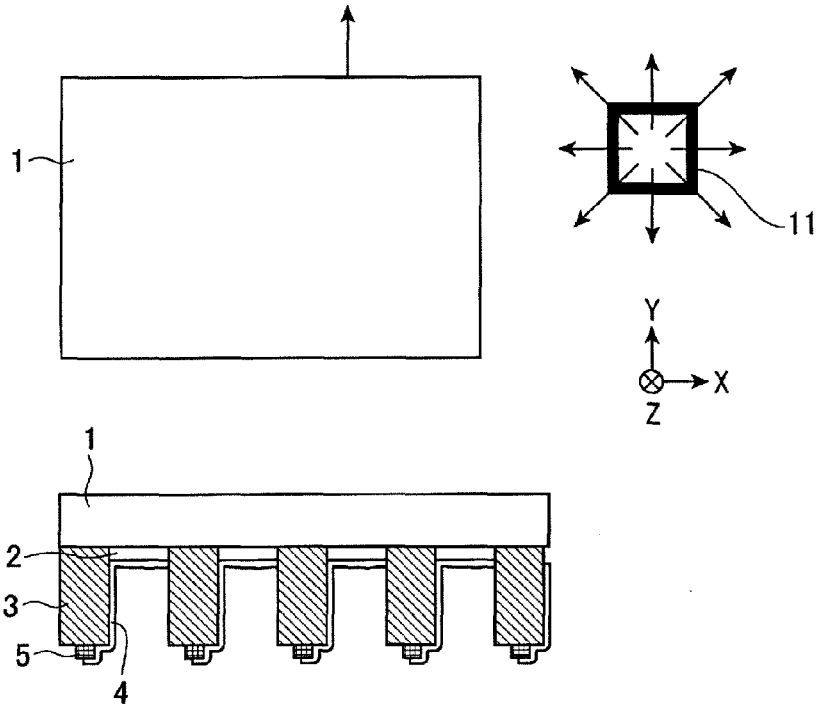
FIGS. 6A to 6C are views for explaining the directionality of the evaporation of the example 1.
Figure 6B:
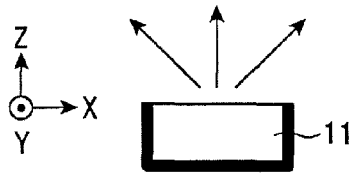
Figure 6C:
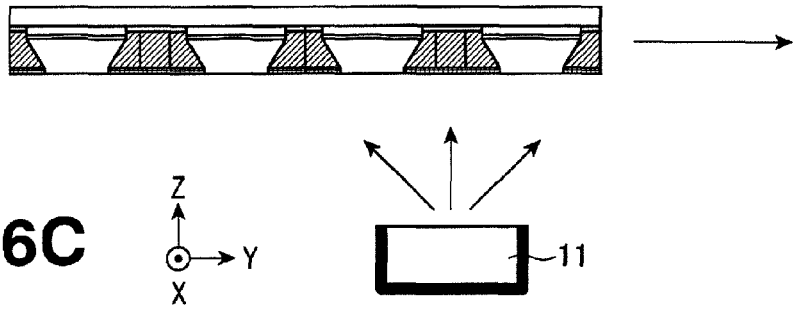

FIGS. 6A to 6C are views for explaining the directionality of the evaporation. As illustrated in FIG. 6A, an evaporation source 11 was disposed at a position offset in the X-direction to the substrate 1. The evaporation was executed while transporting the substrate 1 or the evaporation source 11 in the Y-direction. FIG. 6B illustrates the directionality of the evaporation in the X-direction. Since the substrate 1 was offset from the evaporation source 11 in the X-direction, a metal vapor, which effectively reached the substrate, was incident on the substrate at a predetermined angle or more. Accordingly, the metal backs 4 were formed only from the surfaces of phosphor films 2 to the one wall surfaces and the apexes of the rib structures 3 in the cells partitioned by the rib structures 3. FIG. 6C illustrates the directionality of the evaporation in the Y-direction. The directionality was affected by the positional relation between the evaporation source 11 and the substrate 1 (the mask 9). However, when the substrate 1 and the evaporation source 11 were relatively moved in the Y-direction, the directionality in the Y-direction was canceled, and symmetrical metal backs could be obtained in the Y-direction.

The width in the Y-direction of the metal backs 4 was minimized to 200 μm in the junctions of the apexes of the rib structures 3 (portions connected to the feeding members 5) and increased toward the surface of the substrate. In the example 1, the width in the Y-direction of the first portions 4*a* that cover the phosphor films 2 (refer to the arrow 8 of FIG. 2) was 400 μm. At the time, the distance between the first portions 4*a* of the metal backs 4 and the X-directional lines 5*b* (refer to the arrow 6 of FIG. 2) was 175 μm, and the distance between the metal backs 4 on the respective apexes of the rib structures 3 and the X-directional lines 5*b* was 165 μm (refer to the arrow 12 of FIG. 2).

After the aluminum was evaporated, the resin intermediate films were removed by calcining them at 450° C.

(Step 5: Formation of Common Electrode)

Next, a common electrode 12 was formed to connect the feeding members 5 to a high voltage power supply. The common electrode was a potential defining member commonly connected to a plurality of column lines or a plurality of row lines of the feeding members 5. The common electrode defined the feeding members 5 to a potential (accelerating voltage) supplied from the high voltage power supply. The common electrode was formed to have a sheet resistance lower than that of the feeding members 5.

As illustrated in FIG. 4, the common electrode 12 was disposed to the ends of the Y-directional lines of the feeding members 5. The common electrode 12 was formed by screen print using a paste containing silver particles, glass frit, and a resin binder. The resistance value between the ends of the formed common electrode 12 was 30Ω. After the common electrode 12 was formed by the screen print, it was calcined at 450° C.

(Step 6: Formation of Panel)

A display panel was formed using the formed face plate and a rear plate on which surface-conductive electron-emitting devices were disposed. When an image was displayed by applying a voltage of 10 kV to the metal backs 4 through the common electrode 12 and by applying a drive voltage to the electron-emitting devices, a good image having a high luminance could be obtained.

Further, an excessive voltage was applied to particular electron-emitting devices and the devices were broken so that electric discharge was induced between the electron-emitting devices and the face plate 1. However, since a discharge current was sufficiently restricted, the devices in the periphery of the intentionally broken devices were not placed in an abnormal state. Further, no collapse arose between the metal backs and between the metal backs and the feeding members.

EXAMPLE 2

An example 2 shows an electron beam display using the face plate illustrated in FIGS. 3A to 3C. However, a method of forming the rib structures and the phosphor films is the same as that of the example 1, and description thereof will not be repeated.

Figure 7A:
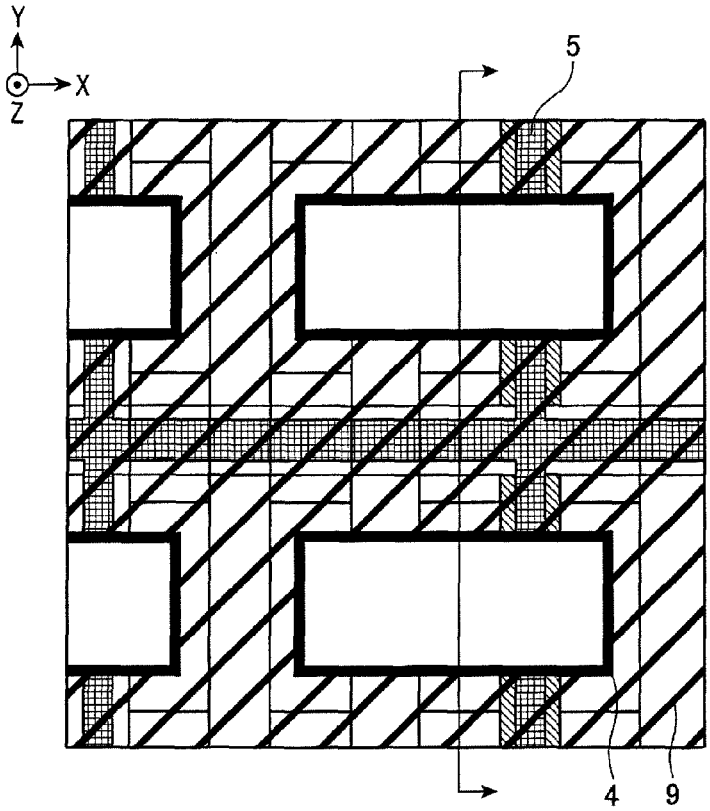
FIGS. 7A to 7C illustrate a method of disposing a mask of an example 2 and a directionality of evaporation.
Figure 7B:
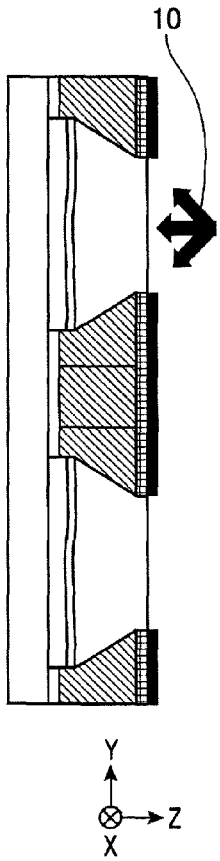
Figure 7C:
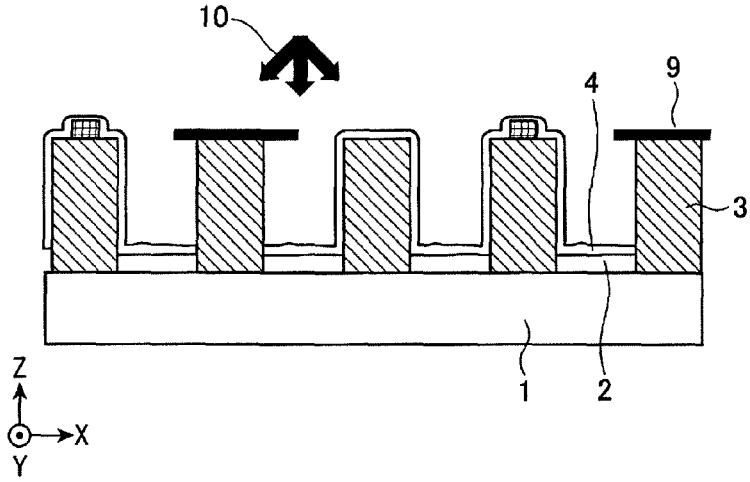

FIGS. 7A to 7C and FIGS. 8A to 8C illustrate a method of forming the metal backs of the example 2. FIGS. 7A to 7C illustrate disposition of the mask 9 at the time aluminum as a material of the metal backs was formed to be films and the directionality 10 of evaporation. The portion shown by slanting lines of FIG. 7A is a region to be masked by the mask 9. Openings having a shape corresponding to three subpixels constituting one pixel were formed on the mask 9. When the evaporation having the directionality 10 was executed using the mask 9, the metal backs 4 having a shape for continuously covering the three phosphor films 2 of RGB were obtained as illustrated in FIG. 7C.

Figure 8A:
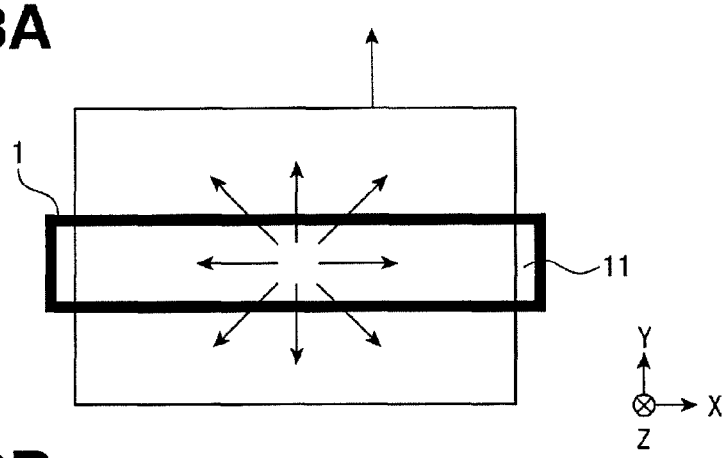
FIGS. 8A to 8C are views for explaining the directionality of the evaporation of the example 2.
Figure 8B:
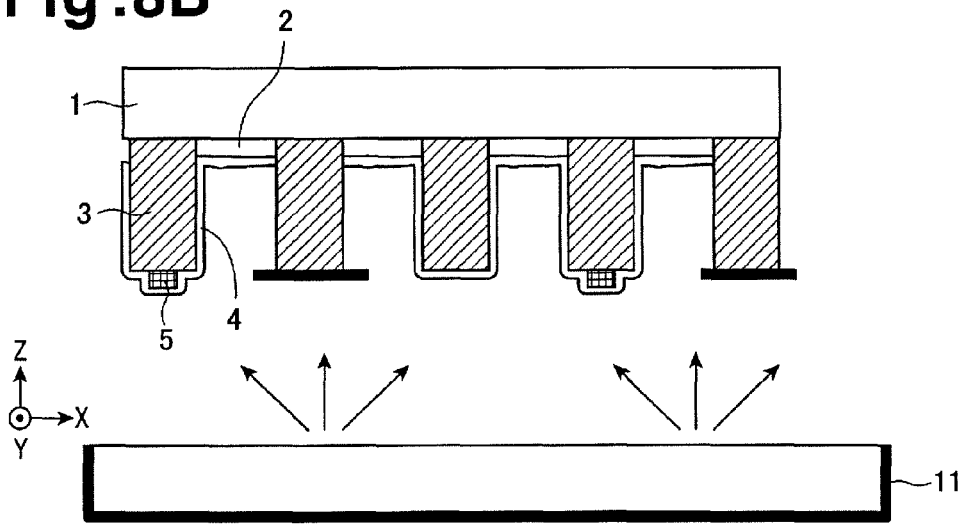
Figure 8C:
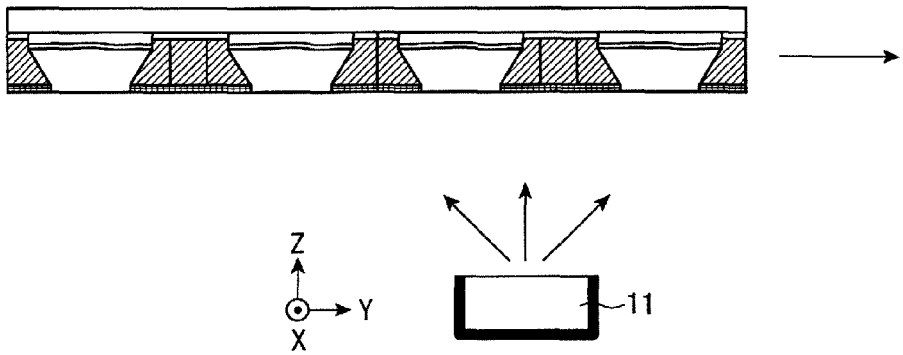

FIGS. 8A to 8C are views for explaining the directionality of the evaporation. As illustrated in FIG. 8A, an evaporation source 11, which was longer than the substrate 1 in the X-direction, was used, and films were formed by causing the substrate to pass just above the evaporation source 11. FIG. 8B illustrates a directionality of evaporation in the X-direction. Since the evaporation source 11 was longer than the substrate 1 in the X-direction, aluminum was evaporated from various directions through the openings of the mask. With this operation, aluminum films were deposited on the rib structures 3 except the wall surfaces of the rib structures 3 behind the mask, and the metal backs having the shape for continuously covering the three phosphor films were formed. FIG. 8C illustrates the directionality in the Y-direction. The directionality was affected by the positional relation between an evaporation source 11 and the substrate 1. However, when the substrate 1 and the evaporation source 11 were relatively moved in the Y-direction, the directionality in the Y-direction was canceled, and symmetrical metal backs could be obtained in the Y-direction.

A display panel was formed using the formed face plate and the rear plate on which surface-conductive electron-emitting devices were disposed. When an image was displayed by applying a voltage of 10 kV to the metal backs 4 through the common electrode 12 and by applying a drive voltage to the electron-emitting devices, a good image having a high luminance could be obtained.

Further, an excessive voltage was applied to particular devices and the particular devices were broken so that electric discharge was induced between the electron-emitting devices and the faceplate 1. However, since a discharge current was sufficiently restricted, the peripheral devices excluding the intentionally broken devices were not placed in an abnormal state. Further, no collapse arose between the metal backs and between the metal backs and the feeding members.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-328064, filed on Dec. 24, 2008, which is hereby incorporated by reference herein in its entirety.

What is claimed is:

1. An image display apparatus comprising:

a plurality of phosphor films two-dimensionally disposed on a substrate;

a matrix-pattern rib formed on the substrate to partition the phosphor films;

a plurality of metal backs each covering at least one phosphor film; and resistance wirings which have a sheet resistance higher than that of the metal backs, and electrically connect the plurality of metal backs to each other, wherein the resistance wirings are disposed to apexes of the matrix-pattern rib and composed of a plurality of column lines and a plurality of row lines, the metal backs have first portions covering the phosphor films on the substrate and second portions formed along the rib to connect the first portions to the column lines, and a width of the second portions in a column direction at the apexes of the rib is smaller than a width of the first portions in the column direction.

2. The image display apparatus according to claim 1, wherein the metal backs have a plurality of first portions covering a plurality of phosphor films disposed in the row direction across the rib, and a third portion formed along the rib to connect between two adjacent first portions, and a width of the third portion in the column direction at the apexes of the rib is smaller than the width of the first portions in the column direction.

3. The image display apparatus according to claim 1, wherein one pixel is composed of N pieces, with N being an integer equal to or more than 2, of phosphor films, and one metal back covers the N pieces of the phosphor films of the one pixel.

4. The image display apparatus according to claim 1, wherein the plurality of column lines or the plurality of row lines are connected to a potential defining member having a sheet resistance lower than that of the resistance wirings.

* * * * *